US011092009B2

(12) United States Patent
Garcia et al.

(10) Patent No.: US 11,092,009 B2
(45) Date of Patent: Aug. 17, 2021

(54) CUTTING APPARATUS

(71) Applicant: SANDVIK INTELLECTUAL PROPERTY AB, Sandviken (SE)

(72) Inventors: Luis Garcia, Zeltweg (AT); Guenther Staber, Murau (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/607,500

(22) PCT Filed: Mar. 30, 2018

(86) PCT No.: PCT/EP2018/058269
§ 371 (c)(1),
(2) Date: Oct. 23, 2019

(87) PCT Pub. No.: WO2018/197154
PCT Pub. Date: Nov. 1, 2018

(65) Prior Publication Data

US 2020/0141236 A1 May 7, 2020

(30) Foreign Application Priority Data

Apr. 24, 2017 (SE) ..... 1750479-6

(51) Int. Cl.
*E21C 25/18* (2006.01)
*E21D 9/10* (2006.01)
*E21D 9/11* (2006.01)

(52) U.S. Cl.
CPC ..... *E21D 9/104* (2013.01); *E21C 25/18* (2013.01); *E21D 9/117* (2013.01)

(58) Field of Classification Search
CPC ..... E21C 25/16; E21C 25/18; E21C 27/24; E21D 9/1006; E21D 9/104; E21D 9/11
See application file for complete search history.

(56) References Cited

U.S. PATENT DOCUMENTS 4,339,009 A * 7/1982 Busby ..... E21B 10/52 175/374
10,533,416 B2 * 1/2020 Lugg ..... E21D 9/1026
2003/0230925 A1 12/2003 Oishi
2006/0061206 A1 * 3/2006 Nava ..... E21C 25/18 299/110
2009/0058172 A1 * 3/2009 de Andrade ..... E21D 9/1013 299/55

FOREIGN PATENT DOCUMENTS

DE 202111050143 8/2012
WO WO02066793 A1 * 8/2002
(Continued)

*Primary Examiner* — Sunil Singh
(74) *Attorney, Agent, or Firm* — Corinne R. Gorski

(57) ABSTRACT

A cutter for a cutting unit used in cutting apparatus suitable for creating tunnels or subterranean roadways. The cutter includes a disc body having an underside, an upper side arranged substantially opposite to the underside, and a radially peripheral part. A plurality of buttons for abrading rock are mounted in the radially peripheral part of the disc body and protrude outwardly therefrom to engage rock during an undercutting operation, wherein at least some of the buttons have a cutting part having a dome-shaped cutting surface.

17 Claims, 11 Drawing Sheets

(56) References Cited

FOREIGN PATENT DOCUMENTS

| | | | |
|---|---|---|---|
| WO | 2010050872 | A1 | 5/2010 |
| WO | 2011093777 | A1 | 8/2011 |
| WO | 2012156841 | A2 | 11/2012 |
| WO | 2012156842 | A2 | 11/2012 |
| WO | 2012156884 | A2 | 11/2012 |
| WO | 2014090589 | A1 | 6/2014 |
| WO | 2016/055087 | A1 | 4/2016 |
| WO | 2016055382 | A1 | 4/2016 |

* cited by examiner

CUTTING APPARATUS

RELATED APPLICATION DATA

This application is a § 371 National Stage Application of PCT International Application No. PCT/EP2018/058269 filed Mar. 30, 2018 with priority to SE 1750479-6 filed Apr. 24, 2017.

FIELD OF INVENTION

The present invention relates to rock cutting apparatus suitable for creating tunnels or subterranean roadways and in particular, although not exclusively, to undercutting apparatus in which a plurality of rotating heads are capable of being slewed laterally outward and raised in the upward and downward direction during forward cutting. The apparatus is particularly suited to development mining. The present invention also relates to a cutter for a cutting unit used in the cutting apparatus.

Background Art

A variety of different types of excavation machines have been developed for cutting drifts, tunnels, subterranean roadways and the like in which a rotatable head is mounted on an arm that is in turn movably mounted at a main frame so as to create a desired tunnel cross sectional profile. WO2012/156841, WO 2012/156842, WO 2010/050872, WO 2012/156884, WO2011/093777, DE 20 2111 050 143 U1 all described apparatus for mill cutting of rock and minerals in which a rotating cutting head forced into contact with the rock face as supported by a movable arm. In particular, WO 2012/156884 describes the cutting end of the machine in which the rotatable heads are capable of being raised and lowered vertically and deflecting in the lateral sideways direction by a small angle in an attempt to try enhance the cutting action.

WO 2014/090589 describes a machine for digging roadways tunnels and the like in which a plurality of cutting heads are movable to dig into the rock face via a pivoting arcuate cutting path. US 2003/0230925 describes a rock excavator having a cutter head mounting a plurality of annular disc cutters suitable to operate in an undercutting mode.

However, conventional cutting machines are not optimised to cut hard rock having a strength typically beyond 120 MPa whilst creating a tunnel or subterranean cavity safely and reliably of desired cross sectional configuration. WO2016/055087 describes a type of machine that addresses some of these problems, however the inventors have determined that the cutters used on that machine are not as well optimised for the cutting apparatus as they could be.

A further issue with known cutting machines is that the cutters experience large forces during a cutting operation. Typically, disc cutters are mounted on a shaft, and the shaft (and hence disc) is supported for rotation by bearings. The bearings are typically roller bearings. Cutters of this type include buttons to abrade rock. The buttons protrude radially outwards from an edge of the disc. The inventors have determined that the shape of the buttons used in the cutters can significantly affect the lifetime and design of the bearings used to facilitate rotation of the cutter. For example, the inventors have determined that cutters having conical buttons transmit a component of cutting force (often referred to as the "side force") to the bearings that pushes and pulls on the bearing in an alternating fashion during a cutting operation. It is the relatively high frequency of change of direction of the side force transmitted to the bearings that shortens the life of the bearings. Accordingly it is desirable to eliminate or minimise the frequency with which the side force transmitted to the bearings changes direction. In particular, it is desirable to eliminate or minimise the side force being transmitted in the pulling (negative) direction, that is, the direction of pulling the cutter disc away from the bearings, since it is force in this direction that is most damaging to the bearings.

The inventors have also determined that other geometrical aspects of the cutter can also affect the cutting performance of the cutting apparatus.

SUMMARY OF THE INVENTION

It is an objective of the present invention to provide cutting apparatus suitable to form tunnels and subterranean roadways being specifically configured to cut hard rock, say beyond 120 MPa, in a controlled and reliable manner, that is, apparatus capable of mine development work. It is a further objective to provide a cutting apparatus capable of creating a tunnel with a variable cross sectional area within a maximum and a minimum cutting range. It is a further objective to provide cutting (excavator) apparatus operable in an 'undercutting' mode according to a two stage cutting action. It is a further objective to provide a cutter that has an optimised cutting geometry for the cutting apparatus. It is a further objective to provide a cutter that reduces the occurrence of pulling side forces. It is a further object to provide a cutter that has an optimised geometry for balancing cutter strength and reducing cutter wear.

At least some of the objectives are achieved by providing cutting apparatus having a plurality of cutting assemblies, each including a rotatably mounted cutting head that is attached to a support structure by a mounting assembly. Each mounting assembly is arranged to enable its respective cutting head to be pivoted in an upward and downward direction and a lateral side-to-side direction, with respect to the support structure. In particular, each mounting assembly comprises a support pivotally mounted to the support structure and carrying an arm via a respective additional pivot mounting such that each cutting head is capable of pivoting about two pivoting axes. The desired range of movement of each head is provided as the dual pivoting axes are aligned transverse (including perpendicular) to one another and are spaced apart in the longitudinal direction of the apparatus between a forward and rearward end.

Advantageously, the cutting heads comprise a plurality of disc-like roller cutters distributed circumferentially around a perimeter of each head so as to create a groove or channel into the rock face as the heads are driven about their respective rotational axes. The heads may then be raised vertically so as to overcome the relatively low tensile strength of the overhanging rock to provide breakage via force and energy that is appreciably lower than a more common compressive cutting action provided by cutting picks and the like. Advantageously each cutter includes a disc body and an arrangement of hard buttons for abrading the rock. The buttons are arranged in a manner that optimises the cutting action for the cutting apparatus.

At least some of the objectives are achieved by providing a roller cutter that includes a disc body and an arrangement of buttons for abrading the rock, wherein at least some of the buttons each include a domed cutting surface, and preferably substantially a hemi-spherical cutting surface. At least some of the objectives are achieved by providing a cutting head for use in cutting apparatus suitable for creating tunnels or subterranean roadways, said cutting head including a plurality of cutters that each include a disc body and an arrangement of buttons for abrading the rock, wherein at least some of the buttons each include a domed cutting surface, and preferably substantially a hemi-spherical cutting surface. At least some of the objectives are achieved by providing cutting apparatus suitable for creating tunnels or subterranean roadways, said cutting apparatus including a plurality of cutting heads, each cutting head including a plurality of cutters that each include a disc body and an arrangement of buttons for abrading the rock, wherein at least some of the buttons each include a domed cutting surface, and preferably substantially a hemi-spherical cutting surface.

According to one aspect of the invention there is provided a cutter for a cutting unit used in cutting apparatus suitable for creating tunnels or subterranean roadways, said cutter including: a disc body having an underside, an upper side arranged substantially opposite to the underside, and a radially peripheral part; a plurality of buttons for abrading rock, said buttons are mounted in the radially peripheral part of the disc body and protrude outwardly therefrom to engage rock during an undercutting operation, wherein at least some, and preferably each, of the buttons have a cutting part comprising a dome-shaped cutting surface.

The cutting part consists of the dome-shaped cutting surface, and therefore is entirely convex. Accordingly the domed-shaped cutting surface does not include the tapered sides of a conical button. The domed-shaped cutting surface significantly reduces the frequency of pulling (negative) side forces thereby extends the life expectancy of cutting unit bearings. The invention is particularly applicable to cutters used for cutting very hard rock, such as granite.

In preferred embodiments the domed-shaped cutting surface comprises a substantially hemi-spherical cutting surface. The inventors have determined that a substantially hemi-spherical cutting surface reduces the frequency of negative (pulling) side forces most significantly. The substantially hemi-spherical cutting surface also provides a well-balanced cutting surface when considering all the components of the cutting force acting on the buttons. The hemi-spherical buttons are also more robust than conical buttons. Conical buttons are prone to breaking, particularly for smaller sized conical buttons.

In preferred embodiments the radius of the cutting surface is greater than or equal to 8 mm. In preferred embodiments the radius of the cutting surface is less than or equal to 11 mm. Using cutting parts within these ranges provides a good balance between the cutting forces experienced by the buttons and the number of cutting cycles required to abrade a rock face.

In preferred embodiments the disc body includes a plurality of button recesses formed in a radially peripheral surface, and each button includes a mounting part located in a respective button recess. This provides a robust cutter. Typically the cutter includes 30 to 50 button recesses and buttons.

In preferred embodiments each domed cutting surface sits immediately proud of the peripheral surface. That is, each cylindrical mounting part of the button does not protrude beyond the peripheral surface, but rather is located within its respective button recess. In preferred embodiments an edge that defines where the domed cutting surface meets the cylindrical body is substantially aligned with the peripheral surface. In preferred embodiments each mounting part substantially fills its respective button recess.

In preferred embodiments the disc body has a central axis arranged substantially perpendicular to a plane of the disc.

In preferred embodiments the radially peripheral surface comprises a sloping annular surface. In preferred embodiments the sloping annular surface slopes inwardly and downwardly towards the central axis of the disc. Preferably the sloping annular surface is a lower surface.

In preferred embodiments the mounting part is substantially cylindrical and has a radius defining the cylinder, the substantially hemi-spherical cutting surface has a radius defining the cutting surface, wherein the cylinder radius substantially matches the hemi-spherical radius. This is an efficient arrangement.

In preferred embodiments the mounting part is made from a different material from the cutting part, and the cutting part is fixed to the mounting part. This enables a more expensive hard material to be used for the cutting part and a less expensive material to be used for the mounting part. For example, the mounting part can include steel. The cutting part can include tungsten carbide, for example cemented tungsten carbide.

At least some of the buttons each have a central longitudinal axis that subtends an angle $\alpha$ with respect to a reference axis, which extends perpendicularly outwards from the central longitudinal axis of the shaft.

Advantageously in preferred embodiments the angle $\alpha$ is greater than or equal to 20°. In preferred embodiments the angle $\alpha$ is less than or equal to 34°. The inventors have determined through detailed experimentation that buttons aligned in this manner provide the best cutting efficiency for cutting apparatus of this type, which has sideways and upwards-downwards cutting movements.

In preferred embodiments the angle $\alpha$ is less than or equal to 32°, preferably less than or equal to 31°, more preferably less than or equal to 30°, and more preferably still less than or equal to 29°. In preferred embodiments the angle $\alpha$ is greater than or equal to 21°, preferably greater than or equal to 22°, more preferably greater than or equal to 23°, and more preferably still greater than or equal to 24. The inventors have determined that a particularly advantageous range for angle $\alpha$ is 24° to 28°. The inventors have determined that these are particularly effective cutting angles, particularly when angle $\alpha$ is around 28°.

In preferred embodiments the disc body has a recessed underside to reduce frictional engagement between the disc and a rock face during a cutting operation. Reducing frictional engagement between the underside of the disc and the rock face reduces cutter wear. The underside is arranged substantially opposite to the upper side of the disc. The underside faces towards the rock face during a cutting operation.

In preferred embodiments the underside of the disc includes a sloping annular surface that slopes inwardly into the disc body from a radially peripheral part of the disc towards the central axis. When the disc is in a substantially horizontal orientation, with the underside facing downwards, the sloping annular surface slopes upwardly and inwardly from the peripheral part of the disc, and preferably from a lower edge of the disc. In preferred embodiments the maximum diameter of the sloping annular surface is located at the peripheral part of the disc and/or a lower part of the disc.

In preferred embodiments the sloping annular surface subtends an angle $\gamma$ with respect to a reference axis. The reference axis extends perpendicularly outwardly from the central longitudinal axis of the shaft. The angle $\gamma$ is greater than or equal to 2°, preferably greater than or equal to 4°, more preferably greater than or equal to 6°, and more preferably still greater than or equal to 8°. Typically the angle γ is less than or equal to around 20°. It is desirable to have a relatively shallow angle of slope to maximise the amount of material adjacent the buttons, to provide a strong cutting disc. The inventors have determined that a slope of around 6° to 10°, and preferably around 8° is a good balance between reducing friction on the one hand and disc strength on the other.

In preferred embodiments the radially peripheral portion of the disc includes a sloping annular surface, said sloping annular surface sloping inwardly and upwardly towards the central axis of the disc. In preferred embodiments the sloping annular surface subtends an angle β with a reference axis that is arranged parallel with the central axis of the disc, wherein the angle β is greater than 0°, preferably is greater than or equal to 5°, and more preferably is greater than or equal to 10°, and more preferably still is greater than or equal to 15°. The annular sloping surface reduces friction between the disc and the rock face during a cutting operation. Preferably the sloping outer surface slopes inwardly and upwardly from a circumferential edge of the disc. In preferred embodiments the circumferential edge of the disc is the maximum diameter of the disc. However the buttons extend outwardly beyond the maximum diameter of the disc body. The sloping annular surface is located above the first sloping annular surface, when the disc body is oriented horizontally with the underside facing downwards. The first sloping annular surface is a lower surface, with respect to this sloping annular surface. In preferred embodiments the sloping annular surfaces converge towards a peripheral edge of the disc. In preferred embodiments the peripheral edge defines the maximum radius of the disc body. It will be appreciated that the buttons extend radially outwardly beyond the peripheral edge of the disc. In preferred embodiments the sloping annular surface formed in the underside of the disc body and this sloping annular surface formed in the radially peripheral part of the disc body converge towards a lowermost edge of the disc body.

It is desirable to have a relatively small angle β to maximise the amount of material adjacent the buttons, to provide a strong cutting disc. However, the smaller the angle β the greater the amount of friction between the disc and the rock face during a cutting operation. In preferred embodiments the angle β is less than or equal to 65°, preferably is less than or equal to 60°, and more preferably is less than or equal to 55°, and more preferably still less than or equal to 50°. The inventors have determined that a slope of around 35° to 45°, and particularly around 40°, is a good balance between reducing friction on the one hand and disc strength on the other.

In preferred embodiments the disc body is annular.

According to another aspect of the invention there is provided a cutting unit for a cutting head used in cutting apparatus suitable for creating tunnels or subterranean roadways and the like, said cutting unit having: a shaft, at least one bearing rotatably supporting the shaft, and a cutter according to any configuration described herein mounted to the shaft.

The upper side of the disc body faces away from the rock face during a cutting operation. In preferred embodiments the shaft includes a flange. The upper side faces towards the shaft flange. Typically the upper side is substantially planar, or includes a substantially planar portion. In preferred embodiments the upper side abuts the shaft flange.

According to another aspect of the invention there is provided a cutting head for cutting apparatus suitable for creating tunnels or subterranean roadways and the like, said cutting head having: a rotatable cutting head body; and a plurality of cutting units according to any configuration described herein mounted on the cutting head body.

In preferred embodiments the cutting units are mounted to a radially peripheral part of the cutting head body. Typically a cutting head includes around 6 to 20 cutting units, and preferably around 8 to 16 cutting units.

In preferred embodiments the cutting units are distributed around a pitch circle on the cutting head body.

At least some, and preferably each, of the cutting discs are arranged to freely rotate. That is, at least some, and preferably each, of the cutting discs are not independently directly driven to rotate by a drive source. Instead, all of the cutting discs are mounted to a cutting head body. The cutting head body is rotatable, typically driven by a motor. Thus the cutting disc bodies rotate with the cutting head body. However, each cutting disc body is arranged to rotate freely with respect to the cutting head body. Thus the cutting discs rotate relative to the cutting head body in response to frictional engagement with the rock face.

According to another aspect of the invention there is provided cutting apparatus suitable for creating tunnels or subterranean roadways and the like comprising: a support structure having generally upward, downward, frontward and side facing regions; and first and second cutting assemblies. Each of the first and second cutting assemblies includes a rotatable cutting head and a mounting assembly. The mounting assembly attaches the cutting head to the support structure in a manner that enables the cutting head to move with respect to the support structure. The mounting assembly includes a first pivot axis wherein the cutting head is movable about the first pivot axis thereby enabling the cutting head to move in a generally sideways direction relative to support structure, and said mounting assembly including a second pivot axis wherein the cutting head is movable about the second pivot axis thereby enabling the cutting head to move in a generally upwards-downwards direction relative to the support structure. Each of the cutting heads includes a plurality of cutting units, each cutting unit includes a rotatable shaft having a central longitudinal axis, at least one bearing rotatably supporting the shaft and a cutter according to any configuration described herein mounted to the shaft.

In preferred embodiments each mounting assembly includes: a support pivotally mounted relative to the support structure via a the first pivot axis, which is aligned generally upright relative to the upward and downward facing regions such that each support is configured to pivot laterally in a sideways direction relative to the side facing regions; at least one support actuator to actuate independent movement of each of the supports relative to the support structure; an arm assembly pivotally mounted to the support via the second pivot axis aligned in a direction extending transverse including perpendicular to each support pivot axis to enable the arm to pivot independently relative to the support in an upward and downward direction relative to the upward and downward facing regions; at least one arm actuator to actuate independent pivoting movement of the arm relative to the support; wherein each rotatable cutting head is mounted towards a free end of its respective arm, and each cutting head is rotatable about a head axis orientated to extend substantially transverse to each arm pivot axis, and the cutting units provide an undercutting mode of operation. This provides a flexible cutting action that can develop new mines.

The first and second cutting assemblies are independently operable from one another. The first and second cutting heads are moveable independently of each other. The cutting units are distributed about a peripheral edge of each cutting head. Typically each cutting head includes at least 4 cutting units. Typically each cutting head includes less than or equal to 20 cutting units. The cutting units are preferably distributed about a pitch circle on the cutting head.

In preferred embodiments each rotatable cutting head is mounted towards a free end of its respective arm, and each cutting head is rotatable about a head axis orientated to extend substantially transverse to each arm pivot axis. Preferably the cutting units provide an undercutting mode of operation.

The configuration of each head to provide the undercutting action is advantageous to break the rock with less force and in turn provide a more efficient cutting operation that draws less power. Preferably, the apparatus comprises a plurality of cutters independently rotatably mounted at each rotatable cutting head. Preferably, the cutters are generally annular cutters each having a generally annular cutting edge or layered cutting edges to provide an undercutting mode of operation. More preferably, the cutters are mounted at a perimeter region of each cutting head such that the cutters circumferentially surround each cutting head. Such a configuration is advantageous to provide the undercutting action of the apparatus with the cutters first creating a channel or groove extending generally horizontally in the rock face. The cutters may then be moved upwardly to break the rock by overcoming the tensile forces immediately above the channel or groove. A more efficient cutting operation is provided requiring less force and drawing less power. Preferably, the cutters are mounted at generally cylindrical bodies and comprise generally annular cutting edges distributed around the perimeter of the cutting head. Each generally circular cutting edge is accordingly positioned side-by-side around the circumference of the cutting head with each cutting edge representing an end most part of each pivoting arm. Preferably an alignment of the rotational axes of the cutters relative to the rotational axis of the respective cutting head is the same so that the respective cutting edges are all orientated in the same position around the cutting head.

In preferred embodiments each arm actuator comprises a planetary gear assembly mounted at the junction at which each arm pivots relative to each support. The apparatus may comprise a conventional planetary gear arrangement such as a Wolfram type planetary gear having a high gear ratio. The planetary gear assembly is mounted internally with each arm such that the cutting apparatus is designed to be as compact as possible In preferred embodiments each arm actuator includes at least one first drive motor to drive the pivoting movement of the arm relative to the support. Preferably, the apparatus comprises two drive motors to drive each of the first and second arms about their pivoting axis via the respective planetary gears. Preferably, the respective drive motors are mounted in-board of each arm and are coupled to each arm via the planetary gear assembly and/or an intermediate drive transmission.

In preferred embodiments each cutting assembly includes at least one second drive motor to drive rotation of the cutting head relative to the arm. In some embodiments each head comprises two drive motors mounted at the side of each arm. Such an arrangement is advantageous to pivot each drive motor with each cutting head and to provide a direct drive with minimal intermediate gearing.

In preferred embodiments each support actuator comprises a hydraulic linear actuator. Preferably, each support actuator comprises a linear hydraulic cylinder positioned at the lateral sides of the support structure and coupled to extend between the sled and an actuating flange extending laterally outward from each support. Such an arrangement is advantageous to minimise the overall width of the apparatus whilst providing an efficient mechanism for the sideways lateral slewing of each support and accordingly each arm.

In preferred embodiments the support structure includes a main frame and a powered sled movably mounted at the main frame to be configured to slide in a forward cutting direction of the apparatus relative to the main frame. The apparatus may further comprise a plurality of 'runners' or guide rails to minimise the frictional sliding movement of the sled over the main frame. Preferably, the apparatus comprises at least one powered linear actuator to provide the forward and rearward movement of the sled relative to the main frame. As will be appreciated, the sled may be configured to move axially/longitudinally at the machine via a plurality of different actuating mechanisms including rack and pinion arrangements, belt drive arrangements, gear arrangements and the like. Preferably the supports and the arms are mounted at the sled and are all configured to move in the forward and rearward direction collectively.

In preferred embodiments each cutting head is mounted at the sled via its respective arm and support so as to be configured to advance in the forward cutting direction. Optionally, the sled may be positioned to operate longitudinally between the supports and each of the respective arms. That is, each arm may be configured to slide in the axially forward direction relative to each support via one or a plurality of actuators. Optionally, each arm is connected to each support via a respective sliding actuator such that each arm is configured to slide independently relative to one another. Optionally, each arm may be configured to slide in a forward and rearward direction relative to each support via a coordinated parallel sliding mechanism.

In preferred embodiments each arm is configured to pivot in the upward and downward direction by up to 180°; and each support is configured to pivot in the lateral sideways direction by up to 90°. Optionally, each arm may be configured to pivot over a range of up to 155°. Optionally, the first and second supports are configured to pivot in the lateral sideways direction by up to 90°. Optionally, the supports may be configured to pivot up to 20° in the lateral sideways direction. Such a configuration provides control of the profile shape and avoids any cuts or ridge that would otherwise remain on the roof and floor of the as-formed tunnel.

In preferred embodiments the apparatus comprises tracks or wheels mounted at the main frame to allow the apparatus to move in a forward and rearward direction. The tracks or wheels enable the apparatus to be advanced forwardly and rearwardly within the tunnel both when manoeuvred into and from the cutting face between cutting operations and to be advanced forwardly during cutting operations as part of the cut-and-advance cutting cycle that also utilises the sliding sled.

According to another preferred embodiment of the invention there is provided cutting apparatus suitable for creating tunnels or subterranean roadways and the like comprising, the cutting apparatus including: a main frame having generally upward, downward and side facing regions; a powered sled movably mounted at the main frame to be configured to slide in a forward cutting direction of the apparatus relative to the main frame; first and second arms pivotally mounted to the sled by respective pivot arm axes aligned in a direction extending transverse including perpendicular to a longitudinal axis of the main frame to allow each arm to pivot independently of one another in an upward and downward direction relative to the upward and downward facing region of the main frame; at least one first and second arm actuator to actuate independent pivoting movement of the first and second arms relative to one another and the main frame; each of the first and second arms having a rotatable cutting head mounted at so as to be configured to be moved in the upward and downward direction and advanced in the forward cutting direction, each cutting head rotatable about a head axis orientated to extend substantially transverse to respective pivot arm axes; and wherein each of the cutting heads includes a plurality of cutting units, each cutting unit includes a rotatable shaft having a central longitudinal axis and a cutter mounted to the shaft, said cutter being arranged to any configuration described herein.

In preferred embodiments each of the first and second arms is respectively mounted at a first and second support slidably mounted relative to the main frame via a common or respective slidable means such that each first and second support is configured to slide laterally in a sideways direction relative to the side facing regions.

In preferred embodiments each rotatable cutting head comprises a generally annular roller cutter each having a generally annular cutting edge or layered cutting edges to provide an undercutting mode of operation.

In preferred embodiments each of the roller cutters is independently rotatably to its respective cutting head.

In preferred embodiments the plurality of roller cutters are generally annular roller cutters each having a generally annular cutting edge or layered cutting edges to provide an undercutting mode of operation.

In preferred embodiments each of the first and second arm actuator comprises a planetary gear assembly mounted at the junction at which each arm pivots relative to each support.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Referring to FIGS. 1 to 7, cutting apparatus 100 comprises a support structure 800 mounting a plurality of cutting components configured to cut into a rock or mineral face 1000 to create tunnels or subterranean roadways. Apparatus 100 is configured specifically for operation in an undercutting mode in which a plurality of rotatable roller cutters 127 may be forced into the rock to create a groove or channel and then to be pivoted vertically upward so as to overcome the reduced tensile force immediately above the groove or channel and break the rock. Accordingly, the present cutting apparatus is optimised for forward advancement into the rock or mineral utilising less force and energy typically required for conventional compression type cutters that utilise cutting bits or picks mounted at rotatable heads. However, the present apparatus may be configured with different types of cutting head to those described herein including in particular pick or bit type cutting heads in which each pick is angularly orientated at the cutting head to provide a predetermined cutting attack angle.

Figure 1:
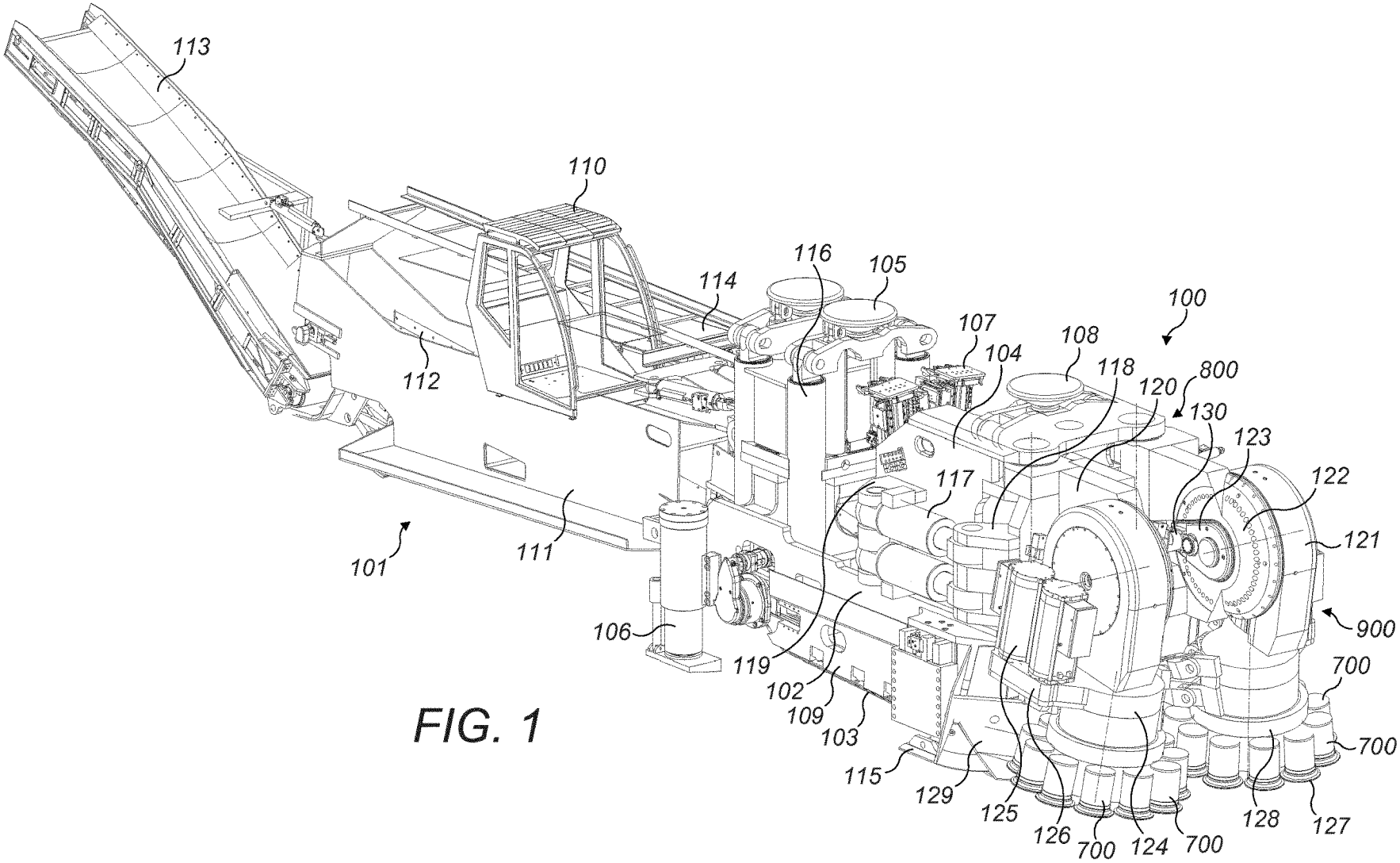
FIG. 1 is a front isometric view of a mobile cutting apparatus suitable for creating tunnels or subterranean roadways having a forward mounted cutting unit and a rearward control unit according to a specific implementation of the present invention.
Figure 2:
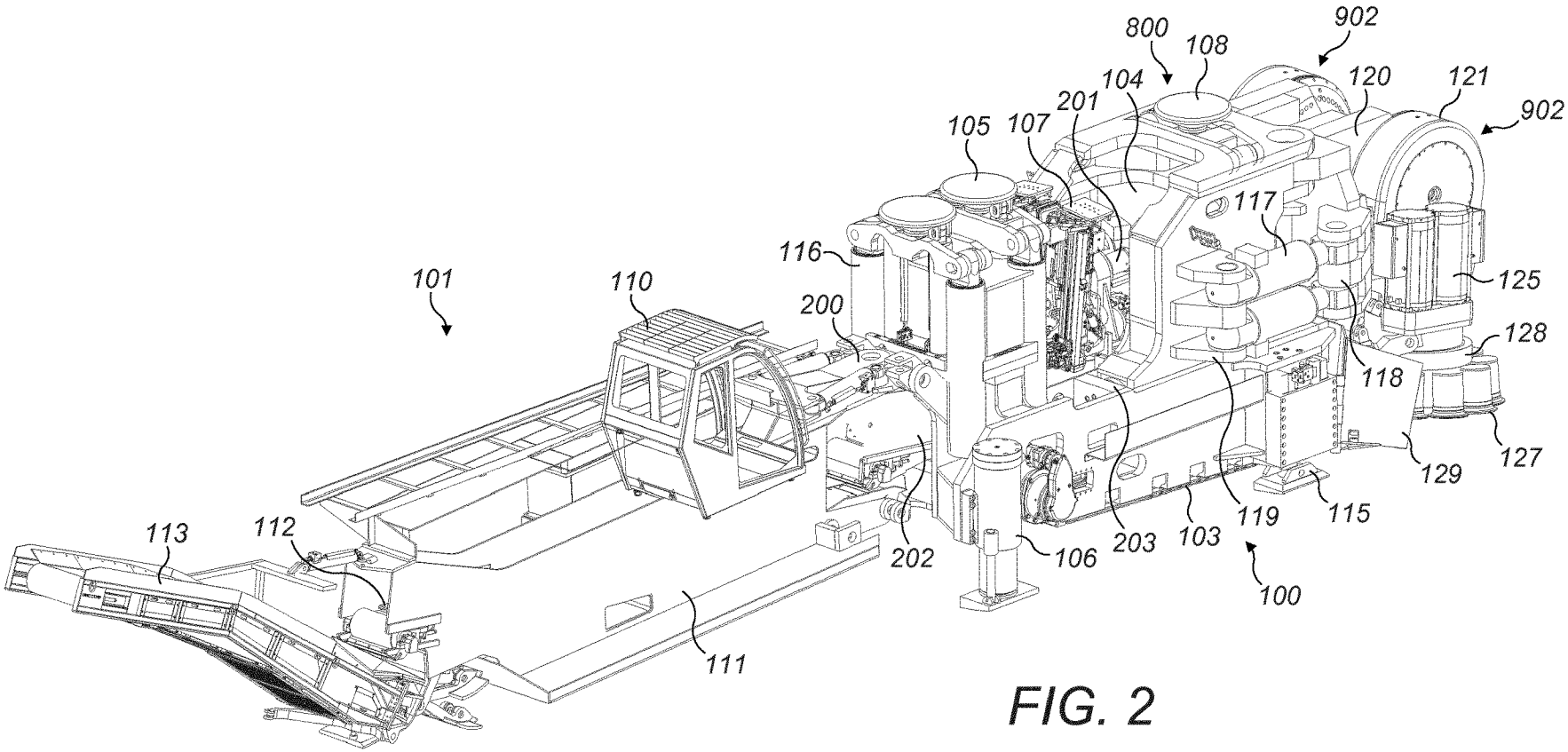
FIG. 2 is a rear isometric view of the cutting apparatus of FIG. 1.
Figure 3:
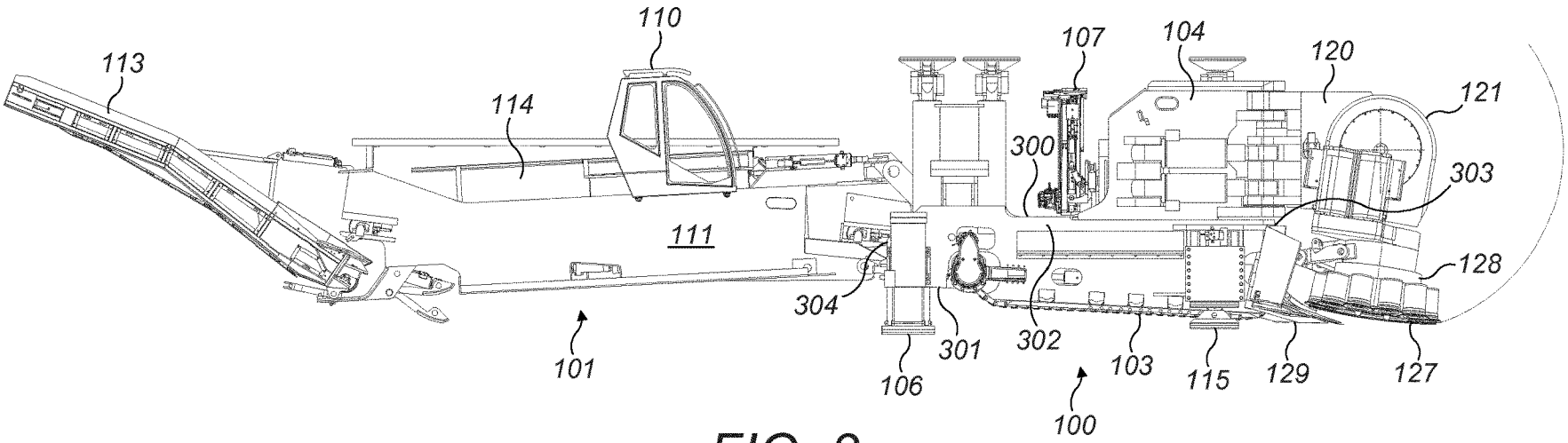
FIG. 3 is a side elevation view of the apparatus of FIG. 2.

Referring to FIGS. 1 to 3, the support structure 800 includes a main frame 102. The main frame 102 comprises lateral sides 302 to be orientated towards the wall of the tunnel; an upward facing region 300 to be orientated towards a roof of the tunnel; a downward facing region 301 orientated to be facing the floor of the tunnel; a forward facing end 303 intended to be positioned facing the cutting face and a rearward facing end 304 intended to be positioned facing away from the cutting face.

The support structure includes an undercarriage 109. The undercarriage 109 is mounted generally below main frame 102 and in turn mounts a pair of crawler tracks 103 driven by a hydraulic (or electric) motor to provide forward and rearward movement of apparatus 100 over the ground when in a non-cutting mode. A pair of rear ground engaging jacking legs 106 are mounted at frame sides 302 towards rearward end 304 and are configured to extend and retract linearly relative to frame 102. Frame 102 further comprises a forward pair of jacking legs 115 also mounted at each frame side 302 and towards forward end 303 and being configured to extend and retract to engage the floor tunnel. By actuation of legs 106, 115, main frame 102 and in particular tracks 103 may be raised and lowered in the upward and downward direction so as to suspend tracks 103 off the ground to position apparatus 100 in a cutting mode. A pair of roof engaging grippers 105 project upwardly from main frame 102 at frame rearward end 304 and are extendable and retractable linearly in the upward and downward direction via control cylinders 116. Grippers 105 are therefore configured to be raised into contact with the tunnel roof and in extendable combination with jacking legs 106, 115 are configured to wedge apparatus 100 in a stationary position between the tunnel floor and roof when in the cutting mode.

The support structure 800 includes a sled 104. The sled 104 is slidably mounted on top of main frame 102 via a slide mechanism 203. Sled 104 is coupled to a linear hydraulic cylinder 201 such that by reciprocating extension and retraction of cylinder 201, sled 104 is configured slide linearly between frame forward and rearward ends 303, 304.

A pair of hydraulically actuated bolting units 107 are mounted at main frame 102 between sled 104 and roof gripping unit 105, 116 relative to a lengthwise direction of the apparatus. Bolting units 107 are configured to secure a mesh structure (not shown) to the roof of the tunnel as apparatus 100 is advanced in a forward cutting direction. Apparatus 100 also comprises a mesh support structure (not shown) mounted generally above sled 104 so as to positionally support the mesh directly below the roof prior to bolting into position.

Figure 5:
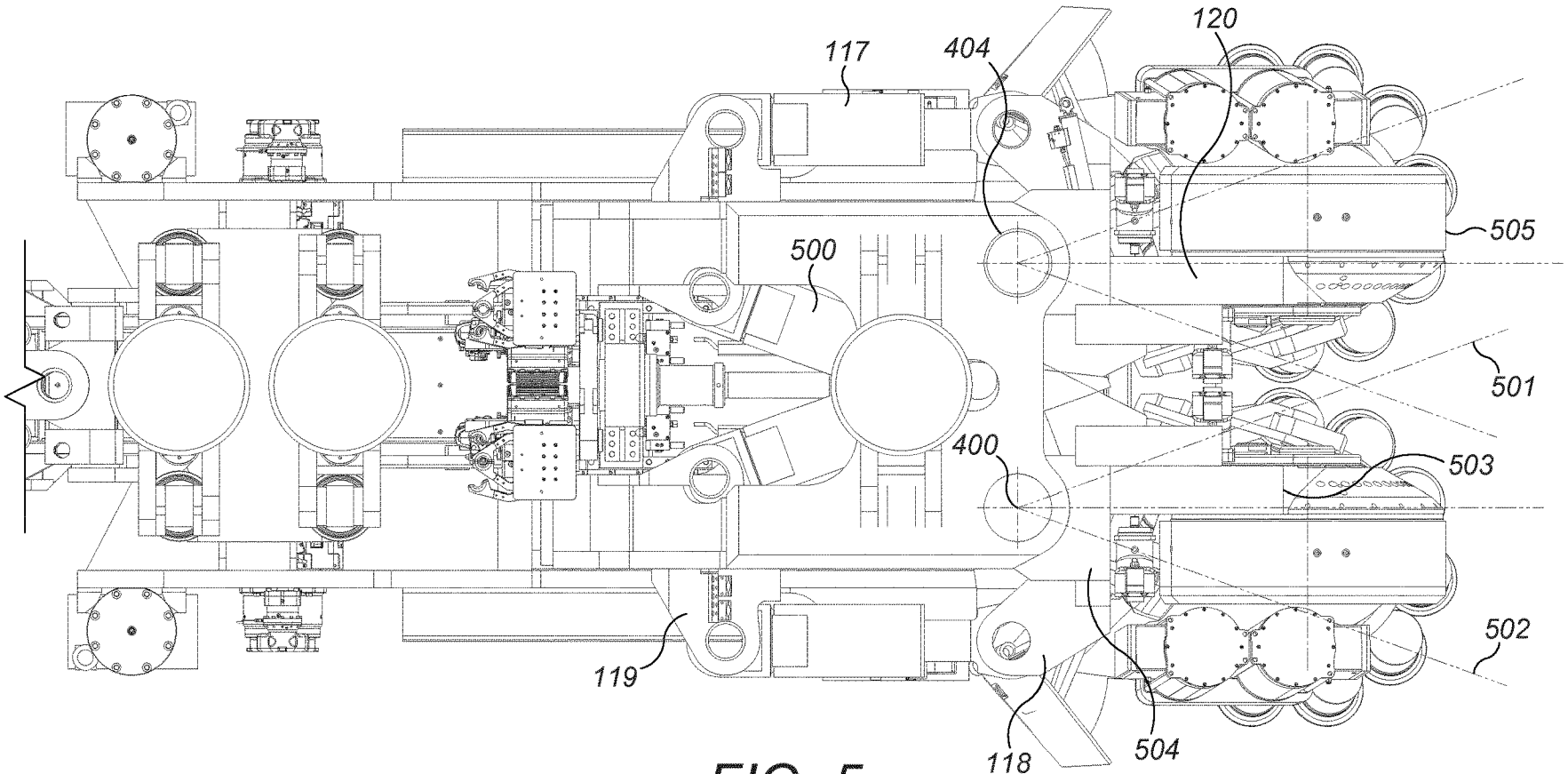
FIG. 5 is a plan view of the cutting apparatus of FIG. 4.
Figure 6:
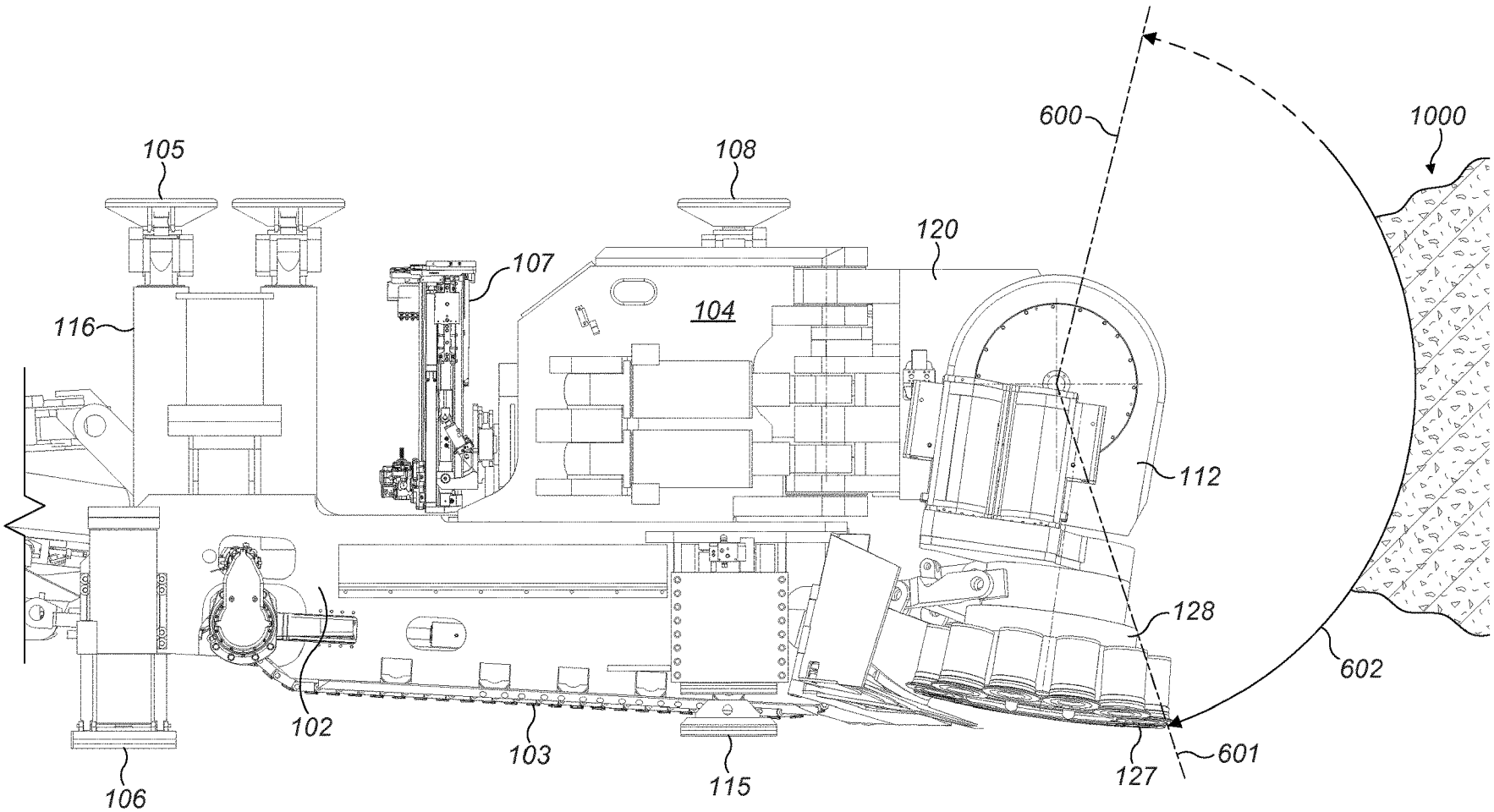
FIG. 6 is a side elevation view of the cutting apparatus of FIG. 5.

The cutting apparatus 100 includes first and second cutting assemblies 900. The first cutting assembly 900 includes a first cutting head 128 and a first mounting assembly 902. The second cutting assembly 902 includes a second cutting head 128 and a second mounting assembly 902. Each of the first and second mounting assemblies 902 includes a support 120. Each support 120 is pivotally mounted at, and projects forwardly from, sled 104 immediately above frame forward end 303. Supports 120 are generally spaced apart in a lateral widthwise direction of the apparatus 100 and are configured to independently pivot laterally outward from one another relative to sled 104 and main frame 102. Each support 120 comprises a forward end 503 and a rearward end 504 referring to FIG. 5. A first mount flange 118 is provided at support rearward end 504 being generally rearward facing. A corresponding second mount flange 119 projects laterally outward from a side of sled 104 immediately behind the first flange 118. A pair of linear hydraulic cylinders 117 are mounted to extend between flanges 118, 119 such that by linear extension and retraction, each support 120 is configured to pivot in the generally horizontal plane and in the lateral sideways direction relative to frame sides 302. Referring to figured 4, each support 120 is mounted at sled 104 via a pivot rod 404 extending generally vertically (when apparatus 100 is positioned on horizontal ground) through sled 104 and being suspended generally above the main frame forward end 303. Each support 120 is therefore configured to pivot or slew about pivot axis 400. Referring to FIG. 5, each support 120 is further coupled to a respective inner hydraulic cylinder 500 mounted at an inner region of sled 104 to cooperate with side mounted cylinders 117 to laterally slew each support 120 about pivot axis 400.

Figure 4:
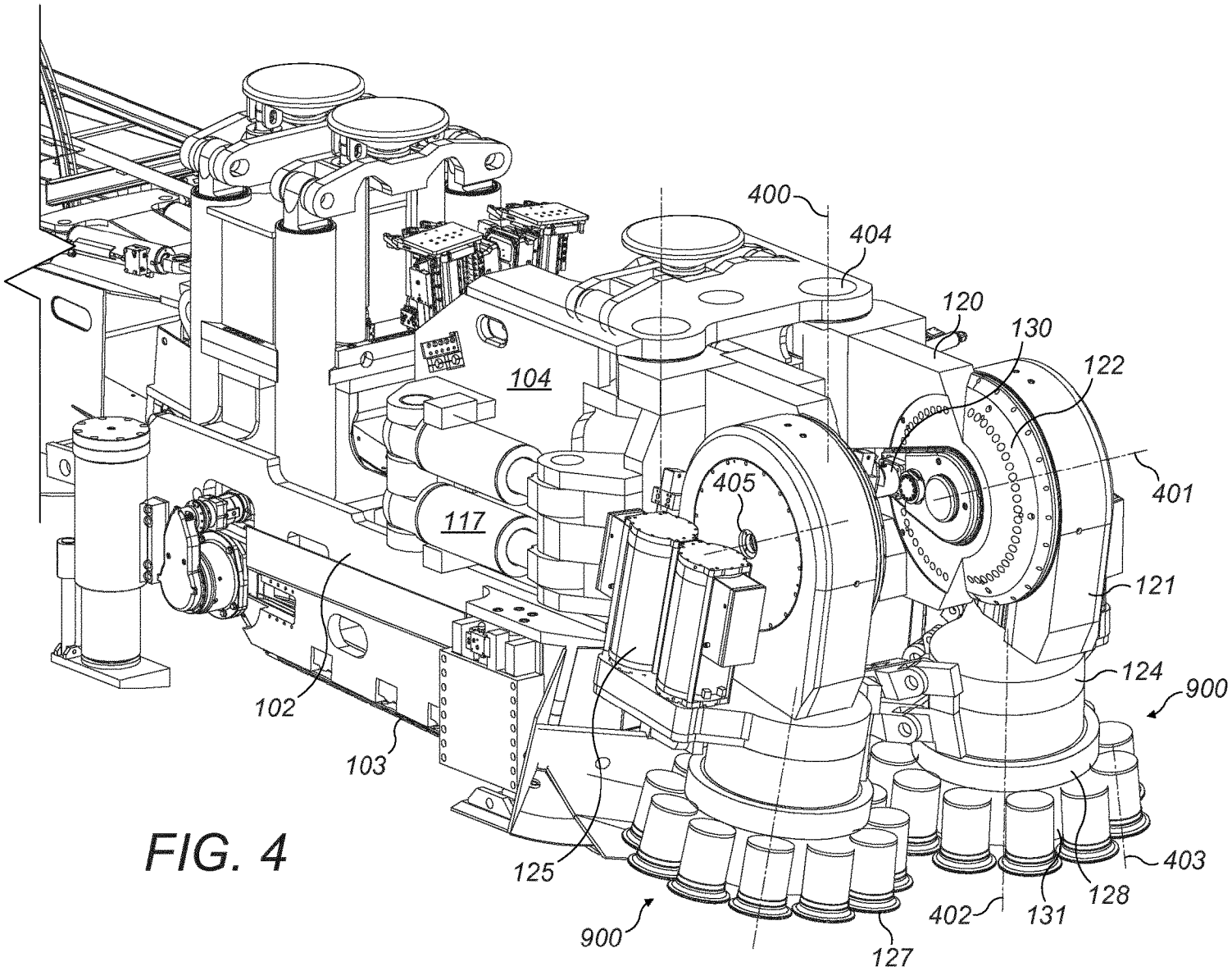
FIG. 4 is a magnified front isometric view of the cutting unit of the apparatus of FIG. 3.

Referring to FIGS. 4 and 5, as the respective pivot axes 400 are spaced apart in the widthwise direction of apparatus 100, supports 120 are capable of being slewed inwardly to a maximum inward position 501 and to be slewed laterally outward to a maximum outward position 502. According to the specific implementation, an angle between the inner and outer slewing positions 501, 502 is 20°.

Referring to FIGS. 1 to 3, each mounting assembly 902 includes an arm 121. Each arm is pivotally mounted generally at the forward end 503 of each support 120. Each cutting head 128 is rotatably mounted at a free distal end of each arm 121. Each cutting head 128 comprises a disk like (generally cylindrical) configuration.

Each cutting head 128 includes a body 131 and 12 cutting units 700. Details of the cutting units 700 are best seen in FIGS. 8 to 11. Each cutting unit 700 includes a casing 701, a shaft 703, a first bearing 705, a second bearing 707, a third bearing 709 and a cutter 127 comprising a disc body 711 and an arrangement of buttons 710. The shaft 703, and hence the disc, has a central longitudinal axis 704. The central axis 704 is arranged substantially perpendicular to the plane of the disc. The shaft 703 is journalled in the first, second and third bearings 705,707,709 and is arranged to rotate freely in the bearings. The bearings 705,707,709 are typically roller bearings. The shaft 703 includes a flange 713 towards a lower end 715 of the shaft. The disc 711 is fixed to the lower end 715 of the shaft, and rotates with the shaft. The disc 711 is attached to the shaft by bolts 717. The bolts 717 pass through holes 719 formed through the plane of the disc 711, and into threaded holes 721 in the flange 713. The disc 711 is annular. The disc 711 has a central through hole 723. The disc 711 is mounted onto the shaft 703 such that the lower end 715 of the shaft protrudes through the central through hole 723. A collar assembly 725 sits in an annular space between an outer surface 727 of the lower end of the shaft and an inner surface 729 of the annular disc.

The disc 711 includes an upper side 730, an underside 732, and a radially peripheral part 738.

The upper side 730 faces generally towards arms 121, and away from the rock face 1000, during an undercutting operation. The upper side 730 includes an annular upper surface 731, which is substantially planar. The upper surface 731 abuts against the flange 713.

The radially peripheral part 738 is generally the outer edge portion of the disc. The radially peripheral part 738 includes a first (upper) annular tapering surface 733, which tapers upwardly and inwardly towards the upper surface 731. The first tapering surface 733 has a maximum diameter at its lower edge 734 and a minimum diameter at its upper edge 736.

The radially peripheral part 738 includes a second (lower) annular tapering surface 735, which tapers downwardly and inwardly from the lower edge 734 of the first tapering surface, to its own lower edge 737. Thus the second annular tapering surface 735 has a maximum diameter at edge 734 and a minimum diameter at edge 737. The edge 734 is the maximum diameter of the disc 711.

The underside 732 faces generally towards the rock face 1000 during an undercutting operation. The underside 732 is recessed to reduce the amount of friction between the disc 711 and the rock face 1000. It will be appreciated that the recessed underside 732 can take many different forms, for example the recessed underside 732 can have a substantially concave formation. A particularly preferred arrangement is for the underside 732 to include an annular tapering surface 739 which tapers inwardly and upwardly from lower edge 737 to upper edge 741. Thus the annular tapering surface 739 has a maximum diameter at lower edge 737 and a minimum diameter at upper edge 741.

Many holes 743 are bored into the annular tapering surface 735. The number of holes is selected according to the application. Typically around 30 to 50 holes 743 are formed in the disc 711. A button 710 is located in each of the holes 743. The buttons 710 are arranged abrade rock as the cutting head 128 rotates. Preferred cutters 127 include 39 or 45 buttons 710.

Each button comprises a mounting part 710*a* and a cutting part 710*b*. The mounting part 710*a* comprises a cylindrical body of radius $R_c$. The cutting part 710*b* comprises a body having a domed cutting surface 712, and in particular the cutting surface consists of a hemi-spherical cutting surface 712. The cutting part 710*b* is mounted at one end of the cylindrical body. Preferably the hemi-spherical surface matches the size of the cylindrical body. That is, the radius $R_{HS}$ of the hemi-spherical cutting surface can be substantially equal to the radius $R_C$ of the cylindrical body. The radius $R_{HS}$ of the hemi-spherical cutting surface is typically in the range 8 to 11 mm.

The cutting part 710*b* body can include a substantially planar underside for engagement with an end face of the cylindrical body. Alternatively, the cutting part 710*b* and the end of the cylindrical body can be arranged for mating engagement. For example, one of the underside of the cutting part and the end of the cylindrical body can include a protrusion and the other of the underside of the cutting part and the end of the cylindrical body can include a recess for receiving the protrusion. This is to assist fixing the cutting part 710*b* to the mounting part 710*a*.

Preferably the cylindrical body 710*b* is made from steel. The hemi-spherical body is made from a hard material such as tungsten carbide. While the buttons 710 are preferably made from two separate parts that are joined together, it will be appreciated that the button 710 can comprise an integral body that includes the mounting part 710*a* and the cutting part 710*b*.

The mounting part 710*a* of the button 710 is inserted into its respective hole 743. The hole 743 is sized to receive the entirety of the mounting part 710*a*. The cutting part 710*b* sits proud of the annular tapering surface 735. Each button 710 protrudes outwardly from the disc beyond the maximum diameter 734 of the disc. Thus the circumscribed diameter of the cutting head 128 is defined by the extent to which the buttons 710 protrude beyond the disc.

Figure 11:
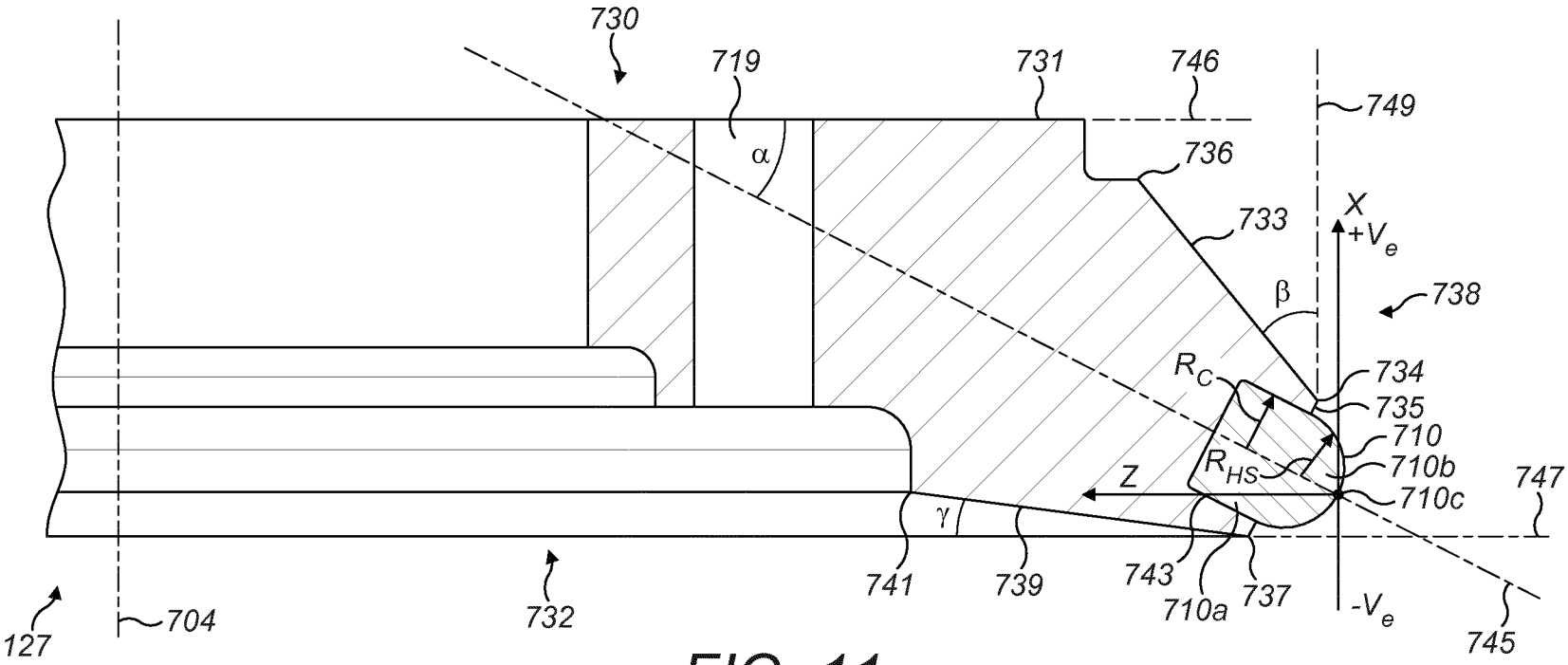
FIG. 11 is an enlarged cross-sectional view of part of the cutting disc of FIG. 9.
Figure 12:
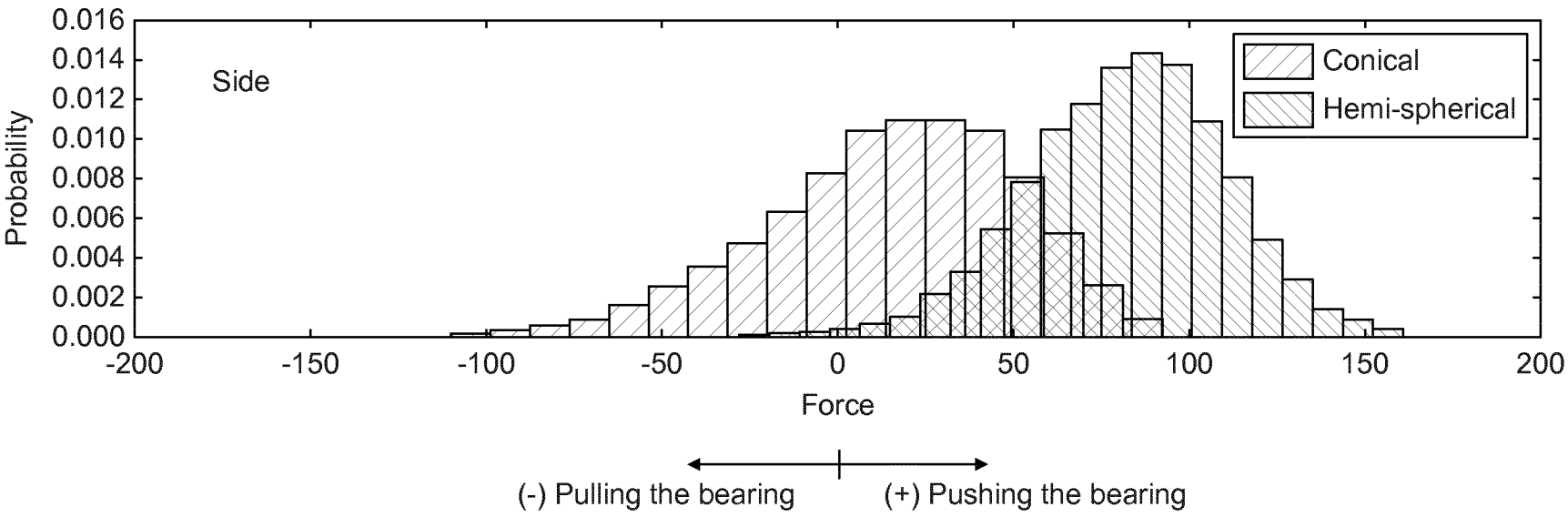
FIG. 12 is a graph showing probability vs side force, and compares side forces experienced by conical and hemispherical cutters during a cutting operation.

During a cutting operation cutting forces are generated at the cutting surface 712 of each button 710. The cutting force can be broken down into three orthogonal component parts, at tip region 710*c*: "side force" (see direction X in FIGS. 10 and 11, wherein a positive force represents the disc pushing on the bearings and a negative force represents the disc pulling on the bearings); "roll force" (see direction Y in FIG. 10, direction Y is perpendicular to the plane of the paper in FIG. 11, wherein a positive force represents the buttons compressing rock and a negative force represents the rock compressing the buttons); and "normal force" (see direction X in FIGS. 10 and 11, wherein a positive force represents the disc pushing on the rock and a negative force represents the disc bouncing back from the rock). The inventors have determined that by using buttons 710 having a hemi-spherical cutting part 710*b*, there is a significant reduction in the extent to which the side force component changes direction during a cutting operation. This is illustrated in the graph of FIG. 12. The graph shows probability (y axis) and side force (x axis) for a cutter including hemi-spherical buttons and, for comparison purposes, a cutter including conical buttons. The data was generated by attaching a cutting unit 700 to a load cell. Since the geometry of the cutting unit 700 and load cell is known, the output from the load cell accurately indicates the magnitude of forces experienced during the cutting operation. In the graph, negative side force values represent pulling side forces, which urge the disc 711 away from the bearings 705,707,709. Positive side force values represent pushing side forces, which urge the disc 711 towards the bearings 705,707,709. It can be seen from the graph in FIG. 12, that the conical buttons produce a negative (pulling) side force for around 30% of the cutting operation. It will be understood by the skilled person that there is a somewhat random alternating of the pushing and pulling forces during a cutting operation for the conical buttons. The graph also shows that the hemi-spherical buttons 710 produce a negative (pulling) side force for a much smaller proportion of the cutting operation, almost to the point of elimination of the side force in the pulling direction.

The inventors have determined that the pulling side forces cause most damage to the bearings 705,707,709. Therefore it is desirable to minimise the pulling side forces. The pushing side forces are less damaging due to the mechanical arrangement of the cutting units 700. The interaction of upper and lower casing members 701*a*,701*b* mechanically blocks the potentially damaging effect of pushing forces on the bearings 705,707,709. Accordingly, the use of hemi-spherical buttons is advantageous to the design and life expectancy of the bearings 705,707,709. This is particularly the case in the context of the cutting apparatus 100.

Each button 710 has a central longitudinal axis 745. The central longitudinal axis of the button 745 subtends an angle $\alpha$ with a reference axis 746, which projects perpendicularly outwards from the central longitudinal axis of the shaft 704 (see FIG. 11). The reference axis 746 is aligned with the plane of the disc body. The angle $\alpha$ determines how the resultant cutting force acting on the tool will be split along the button 710 geometry, and perpendicular to it. An $\alpha=0°$ arrangement would be optimised for a pure shear up cutting movement, however this arrangement would not work in the sump phase. The inventors have determined that $\alpha$ must be larger than zero in order for the machine to operate. For at least some buttons 710, and preferably each button 710, on the disc 711 $\alpha$ is set in the range 20° to 34°, preferably between 24° and 28°. The inventors have determined, after significant testing, that these ranges provide the best overall cutting effect for cutters 127 for this type of boring machine. In particular, taking into account the range of movement of the cutting heads 128 that is undertaken by this type of rock cutting apparatus.

Other geometric aspects of the disc 711 are important for the purposes of strength and the effect of friction caused by rock during a cutting operation. It can be seen from FIG. 11 that the surface 739 subtends an angle $\gamma$ to a reference axis 747. The reference axis 747 is perpendicular to the central longitudinal axis of the shaft 704. The reference axis 747 is aligned with surface 739. The reference axis 747 extends radially outwards from the central longitudinal axis 704 at a position substantially in line with lower edge 737. The inventors have determined that when $\gamma$ is substantially equal to 0° the interaction between the surface 739 and the rock is too large and causes significant wear to the disc. However if $\gamma$ is too large the amount of material that surrounds to the buttons 710 is significantly reduced thereby degrading the strength of the cutter 127. The inventors have determined, by significant testing, that $\gamma$ should be greater than 0°, and ideally should be in the range 3° to 13° to balance friction reduction, while maintaining disc strength. A particularly preferred range is 6° to 10°, and a particularly preferred value is around 8°.

Another geometric aspect of the disc 711 that is important for the purpose of determining the frictional force acting on the disc 711 during a cutting operation is the slope of the second tapered surface 733. It can be seen from FIG. 11 that the second tapered surface 733 subtends an angle $\beta$ with a reference axis 749 which is arranged parallel with the central longitudinal axis 704. In FIG. 11, the reference axis 749 extends vertically upwards from surface 733, for example from the lower edge 734 of the surface, when the disc 711 is in a substantially horizontal orientation with the underside 732 facing downwards towards the ground. The inventors have determined that when $\beta$ is substantially equal to 0° the interaction between the surface 733 and the rock generates large frictional forces, and there is significant wear to the disc 711. The inventors have determined, by significant testing, that $\beta$ should be greater than 0°, and ideally should be in the range 15° to 55° to reduce the frictional forces generated, while maintaining sufficient strength in the vicinity of the buttons 710.

The size of the cutting disc 711 is selected for the application. A preferred maximum diameter of the disc is typically around 17" (431.8 mm).

Thus the plurality of generally annular or disc shaped roller cutters 127 are mounted at the circumferential perimeter of each head 128 and comprise a sharp annular cutting edge configured specifically for undercutting the rock. The cutting units 700 are mounted to the body 131 about a pitch circle, and are typically evenly distributed about the pitch circle. Cutters 127 are rotatably mounted independently relative to one another and head 128 and are generally free to rotate about their own axis. Each cutter 127 projects axially beyond a forwardmost annular edge of head 128 such that when arms 121 are orientated to be extending generally downward, roller cutters 127 represent a lowermost part of the entire head 128 and arm 121 assembly.

Figure 7:
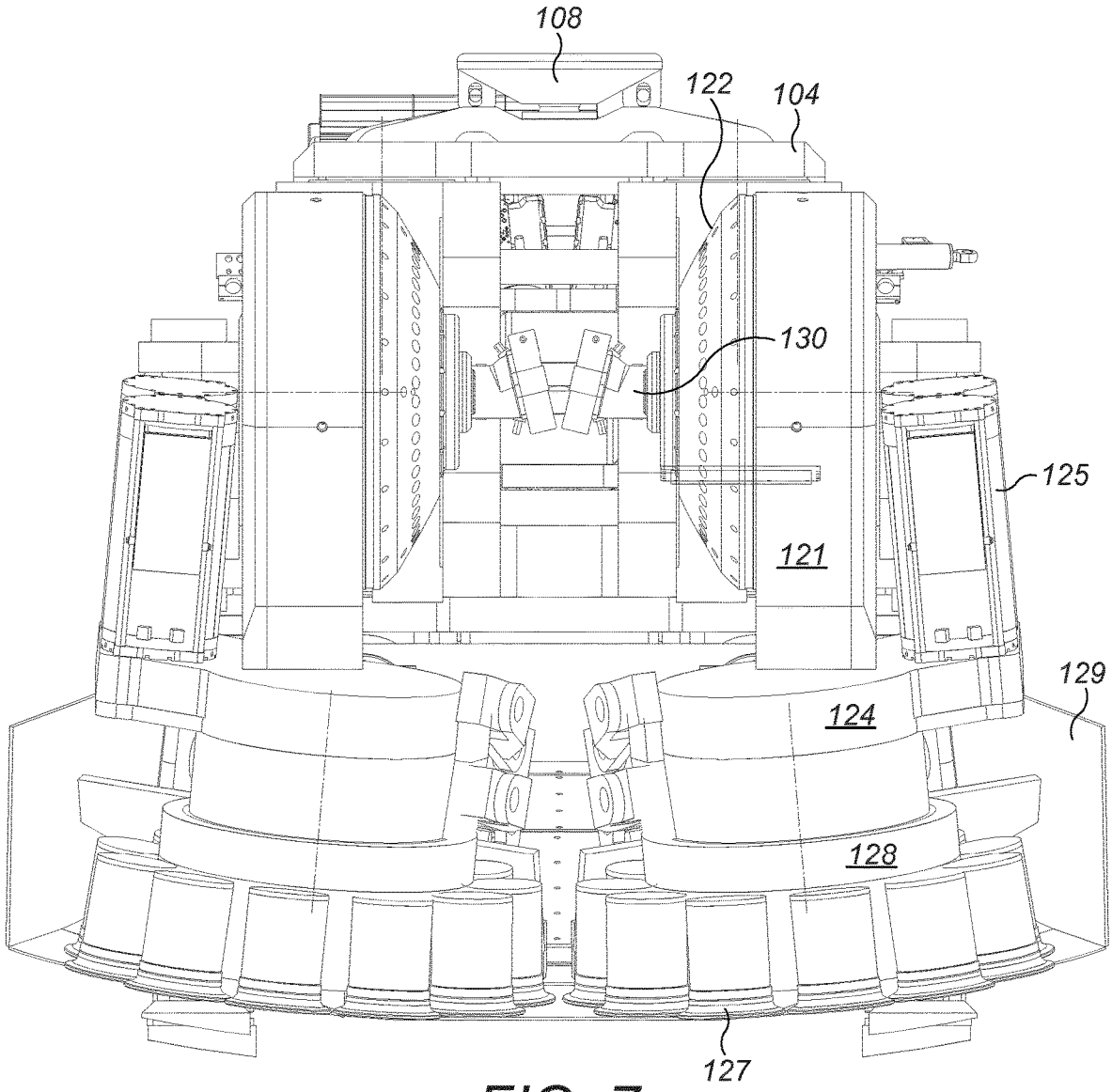
FIG. 7 is a front end view of the cutting apparatus of FIG. 6.
Figure 8:
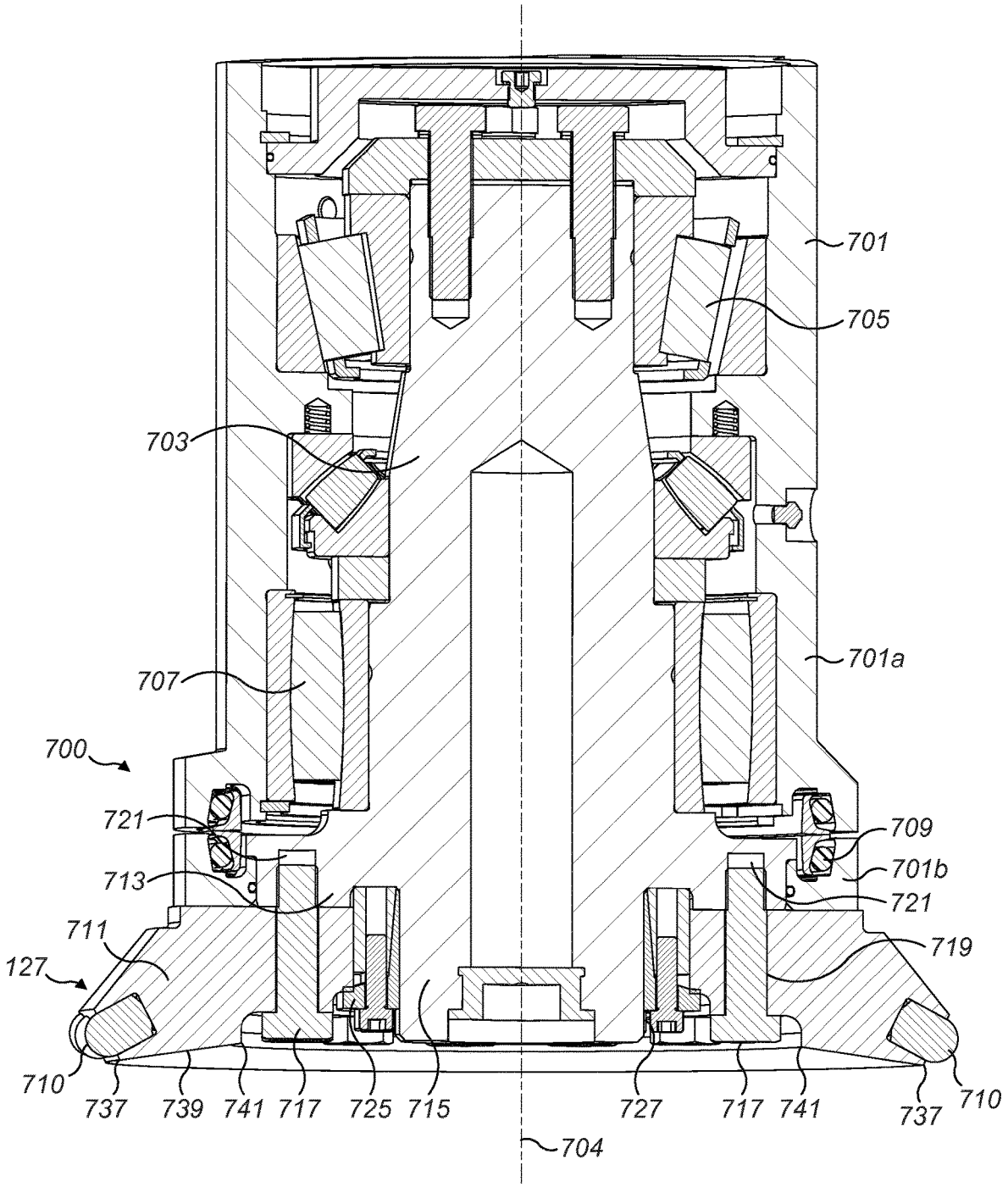
FIG. 8 is a longitudinal cross-sectional view of a cutting unit.
Figure 9:
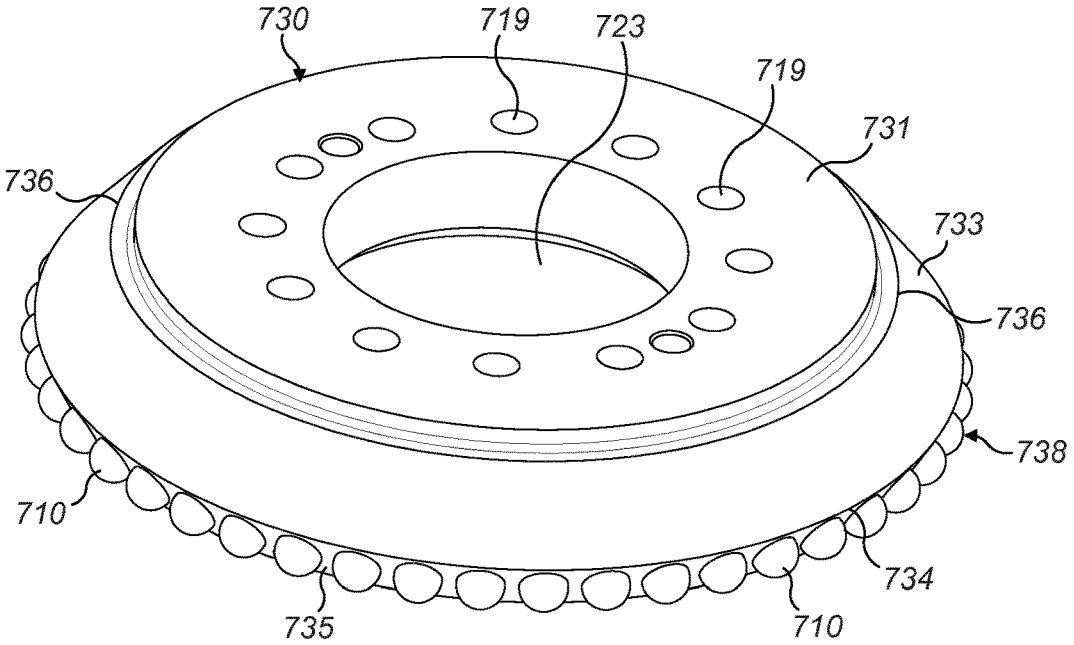
FIG. 9 is an isometric view of a cutting disc included in the cutting unit of FIG. 8, showing a shaft engaging surface of the cutting disc.
Figure 10:
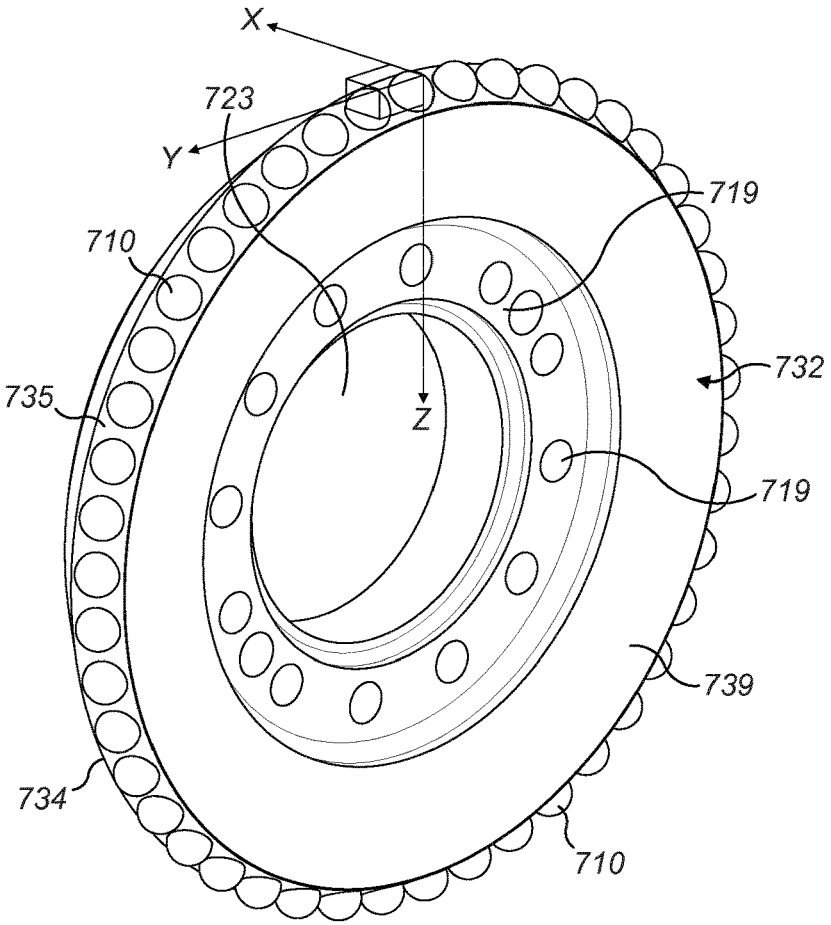
FIG. 10 is an isometric view of a cutting disc included in the cutting unit of FIG. 8, showing an underside of the cutting disc.

Each arm 121 may be considered to comprise a length such that arm 121 is mounted at each respective support 120 at or towards a proximal arm end and to mount each head 128 at a distal arm end. In particular, each arm 121 comprises an internally mounted planetary gear indicated generally be reference 122. Each gear 122 is preferably a Wolfrom type and is coupled to a drive motor 130 via a drive train indicated generally by reference 123. A pair of drive motors 125 are mounted at the lateral sides of each arm 121 and are orientated to be approximately parallel with the rotational axis of each respective cutting head 128 as shown in FIG. 7. Each arm 121 further comprise an internal drive and gear assembly 124 coupled to a gear box 126 mounted at one end of each of the drive motors 125. Each cutting head 128 is driveably coupled to the drive motors 125 via the respective gear assembly 124 to provide rotation of cutting head 128 about axis 402.

As shown in FIG. 7, each arm 121 is coupled to a respective motor 130 mounted at a forward end of sled 104. Each planetary gear 122 is centred on a pivot rod 405 having a pivot axis 401 referring to FIG. 4. Each axis 401 is aligned to be generally horizontal when apparatus 100 is positioned on horizontal ground. Accordingly, each arm 121 is configured to pivot (relative to each support 120, sled 104 and main frame 102) in the upward and downward direction (vertical plane) by actuation of each motor 130. As such, each cutting head 128 and in particular the cutters 127 may be raised and lowered along the arcuate path 602 referring to FIG. 6. In particular, each arm 121, head 128 and cutters 127 may be pivoted between a lowermost position 601 and an uppermost raised position 600 with an angle between positions 600, 601 being approximately 150°. When in the lowermost position 601, each roller cutter 127 and in particular head 128 is suspended in a declined orientation such that a forwardmost cutter 127 is positioned lower than a rearwardmost cutter 127. According to the specific implementation, this angle of declination is 10°. This is advantageous to engage the cutters 127 into the rock face at the desired attack angle to create the initial groove or channel during a first stage of the undercutting operation. Additionally, the extensive range of movement of the cutting heads 128 over the rock face is possible due, in part, to axis 401 being separated and positioned forward relative to axis 400 by a distance corresponding to a length of each support 120.

Thus the cutting movement of the apparatus 100 can be conceptualised as comprising two main sub movements. At first, there is a shallow interaction of the cutters 127 with the rock face towards the mine floor level (often referred to as "sump in"). Here the cut depth is increased from zero to a few millimetres. At this stage each disc body 711 is approximately parallel with the floor, with the underside 732 facing towards the floor.

The arms 128 then move the head 128 upwards across the rock face 1000. In this stage the disc bodies 711 are arranged substantially perpendicular to the floor, or a moving towards that orientation, with the underside 732 facing towards the rock face 1000. At this stage, the cut thickness reaches it maximum. This is typically referred to as "shear up". The shear up phase lasts longer in the cutting cycle.

Referring to FIG. 4, each support pivot axis 400 is aligned generally perpendicular to each arm pivot axis 401. Additionally, a rotational axis 402 of each cutting head 128 is orientated generally perpendicular to each arm pivot axis 401. A corresponding rotational axis 704 of each cutter 127 is angularly disposed relative to the cutting head axis 402 so as to taper outwardly in the downward direction. In particular, each roller cutter axis 704 is orientated to be aligned closer to the orientation of each cutting head rotational axis 402 and support pivot axis 400 relative to the generally perpendicular arm rotational axis 401.

Accordingly, each support 120 is configured to slew laterally outward in a horizontal plane about each support axis 400 between the extreme inner and outward positions 501, 502. Additionally and referring to FIG. 6, each respective arm 121 is configured to pivot in the upward and downward direction about arm pivot axis 401 to raise and lower the cutters 127 between the extreme positions 600, 601.

A gathering head 129 is mounted at main frame forward end 303 immediately rearward behind each cutting head 128. Gathering head 129 comprises a conventional shape and configuration having side loading aprons and a generally inclined upward facing material contact face to receive and guide cut material rearwardly from the cutting face (and cutting heads 128). Apparatus 100 further comprises a first conveyor 202 extending lengthwise from gathering head 129 to project rearwardly from frame rearward end 304. Accordingly, material cut from the face is gathered by head 129 and transported rearwardly along apparatus 100.

Referring to FIGS. 1 to 3, a detachable control unit 101 is mounted to the frame rearward end 304 via a pivot coupling 200. Control unit 111 comprises a personnel cabin 110 (to be occupied by an operator). Unit 111 further comprises an electric and hydraulic power pack 114 to control the various hydraulic and electrical components of apparatus 100 associated with the pivoting movement of supports 120 and arms 121 in addition to the sliding movement of sled 104 and the rotational drive of cutting heads 128.

Control unit 101 further comprises a second conveyor 112 extending generally lengthwise along the unit 101 and coupled at its forwardmost end to the rearwardmost end of first conveyor 202. Unit 101 further comprises a discharge conveyor 113 projecting rearwardly from the rearward end of second conveyor 112 at an upward declined angle. Accordingly, cut material is capable of being transported rearwardly from cutting heads 128 along conveyors 202, 112 and 113 to be received by a truck or other transportation vehicle.

In use, apparatus 100 is wedged between the tunnel floor and roof via jacking legs 106, 115 and roof grippers 105. Sled 104 may then be displaced in a forward direction relative to main frame 102 to engage cutters 127 onto the rock face. Cutting heads 128 are rotated via motors 125 that create the initial groove or channel in the rock face at a lowermost position. A first arm 121 is then pivoted about axis 401 via motor 130 to raise cutters 127 along path 602 to achieve the second stage undercutting operation. The first support 120 may then be slewed in the lateral sideways direction via pivoting about axis 400 and combined with the raising and lowering rotation of cutters 127 creates a depression or pocket within the rock immediately forward of the first arm 121 and support 120. The second arm 121 and associated head 128 and cutters 127 are then actuated according to the operation of the first arm 121 involving pivoting in both the vertical and horizontal planes. This sequential dual pivoting movement of the second arm 121 is independent of the initial dual pivoting movement of the first arm 121. A phasing and sequencing of the pivoting of arms 121 about axes 401 and supports 120 about axes 400 is controlled via control unit 111. The cutters 127 are optimised for the cutting action, and balancing low frictional engagement of the cutters 127 with the rock face 1000 and strength of the cutters 127.

When the maximum forward travel of sled 104 is achieved, jacking legs 106, 115 are retracted to engage tracks 103 onto the ground. Tracks 103 are orientated to be generally declined (at an angle of approximately 10° relative to the floor) such that when ground contact is made, the roller cutters 127 are raised vertically so as to clear the tunnel floor. The apparatus 100 may then be advanced forward via tracks 103. Jacking legs 106, 115 may then be actuated again to raise tracks 103 off the grounds and grippers 105 moved into contact with the tunnel roof to repeat the cutting cycle. A forwardmost roof gripper 108 is mounted above sled 104 to stabilise the apparatus 100 when sled 104 is advanced in the forward direction via linear actuating cylinder 201.

Although the present invention has been described in connection with specific preferred embodiments, it should be understood that the invention as claimed should not be unduly limited to such specific embodiments. Furthermore, it will be apparent to the skilled person that modifications can be made to the above embodiment that fall within the scope of the invention.

For example, the number of cutting units 700 included in a cutting head 128 can be different. Typically a cutting head 128 includes between 6 and 18 cutting units, and preferably between 8 and 16 cutting units.

The invention claimed is:

1. A cutter for a cutting unit used in cutting apparatus suitable for creating tunnels or subterranean roadways, said cutter comprising:

a disc body having an underside, an upper side arranged substantially opposite to the underside, a central axis, and a radially peripheral part, wherein the underside of the disc body is recessed to reduce frictional engagement between the disc body and a rock face during an undercutting operation; and a plurality of buttons for abrading rock, said buttons being mounted in the radially peripheral part of the disc body and protruding outwardly therefrom to engage rock during an undercutting operation, wherein at least some of the buttons have a cutting part having a dome-shaped cutting surface, the radially peripheral part including a first annular tapering surface and a second annular tapering surface, each of the first and second annular tapering surfaces having a lower edge, the second annular tapering surface tapering downwardly and inwardly from the lower edge of the first tapering surface to its lower edge, wherein the underside of the disc body has an annular tapering surface that tapers inwardly and upwardly from the lower edge of the second annular tapering surface to an upper edge of the disc body annular tapering surface, such that the disc body annular tapering surface has a maximum diameter at the lower edge of the second annular tapering surface and a minimum diameter at the upper edge thereof as measured from the central axis, wherein at least some of the buttons each have a central longitudinal axis that subtends an angle $\alpha$ with respect to a first reference axis, which extends perpendicularly outwards from the central axis of the body, wherein $20° \leq \alpha \leq 34°$, wherein the annular tapering surface subtends an $\gamma$ with respect to a second reference axis, which extends perpendicularly outwardly from the central axis, wherein $2° \leq \gamma \leq 20°$, and wherein the first annular tapering surface subtends an angle $\beta$ with a third reference axis that is parallel to the central axis of the body, wherein $5° \leq \beta$.

2. The cutter according to claim 1, wherein the domed-shaped cutting surface is a substantially hemi-spherical cutting surface.

3. The cutter according to claim 2, wherein a radius of the cutting surface is greater than or equal to 8 mm and/or less than or equal to 11 mm.

4. The cutter according to claim 2, wherein each button includes a mounting part located in a respective button recess, the mounting part is substantially cylindrical and has a radius defining a cylinder, and wherein the substantially hemi-spherical cutting surface has a radius defining the cutting surface, the cylinder radius being substantially the same as a radius of the hemi-spherical cutting surface.

5. The cutter according to claim 1, wherein the disc body includes a plurality of button recesses formed in the radially peripheral part, each button including a mounting part located in a respective button recess.

6. The cutter according to claim 5, wherein the mounting part is made from a different material than a material of the cutting part, the cutting part being fixed to the mounting part.

7. The cutter according to claim 1, wherein the domed cutting surface sits immediately proud of the radially peripheral part.

8. The cutter according to claim 1, wherein the radially peripheral part has a sloping annular surface.

9. The cutter according to claim 1, wherein the mounting part includes steel and the cutting part includes tungsten carbide.

10. The cutter according claim 1, wherein the first annular tapering surface forms a sloping annular surface, said sloping annular surface sloping inwardly and upwardly from the second annular tapering surface towards the central axis of the disc.

11. A cutting unit for a cutting head used in a cutting apparatus suitable for creating tunnels or subterranean roadways, said cutting unit comprising:

a shaft;

at least one bearing rotatably supporting the shaft; and a cutter according to claim 1 mounted to the shaft.

12. A cutting head for a cutting apparatus suitable for creating tunnels or subterranean roadways, said cutting head comprising:

a rotatable cutting head body; and a plurality of cutting units according to claim 11 mounted on the cutting head body.

13. The cutting head according to claim 12, wherein the cutting units are mounted to a radially peripheral part of the cutting head body.

14. The cutting head according to claim 12, wherein the cutting units are distributed around a pitch circle on the cutting head body.

15. The cutting head according to claim 12, wherein at least some, of the cutters are arranged to freely rotate.

16. A cutting apparatus suitable for creating tunnels or subterranean roadways, the cutting apparatus comprising:

a support structure having generally upward, downward, frontward and side facing regions;

first and second cutting assemblies, each of the first and second cutting assemblies including a rotatable cutting head and a mounting assembly, the mounting assembly attaching the cutting head to the support structure in a manner that enables the cutting head to move with respect to the support structure, said mounting assembly including a first pivot axis wherein the cutting head is movable about the first pivot axis thereby enabling the cutting head to move in a generally sideways direction relative to support structure, said mounting assembly including a second pivot axis wherein the cutting head is movable about the second pivot axis thereby enabling the cutting head to move in a generally upwards-downwards direction relative to the support structure, and wherein each of the cutting heads includes a plurality of cutting units, each cutting unit including a rotatable shaft having a central longitudinal axis, at least one bearing rotatably supporting the shaft and a cutter according to claim 1 mounted to the shaft.

17. The apparatus according to claim 16, wherein each mounting assembly includes:

a support pivotally mounted relative to the support structure via a the first pivot axis, which is aligned generally upright relative to the upward and downward facing regions such that each support is configured to pivot laterally in a sideways direction relative to the side facing regions;

at least one support actuator arranged to actuate independent movement of each of the supports relative to the support structure;

an arm assembly pivotally mounted to the support via the second pivot axis aligned in a direction extending transverse including perpendicular to each support pivot axis to enable the arm to pivot independently relative to the support in an upward and downward direction relative to the upward and downward facing regions; and at least one arm actuator arranged to actuate independent pivoting movement of the arm relative to the support, wherein each rotatable cutting head is mounted towards a free end of its respective arm, and each cutting head is rotatable about a head axis orientated to extend substantially transverse to each arm pivot axis, and the cutting units provide an undercutting mode of operation.

* * * * *